US006062493A

United States Patent [19]

Abplanalp

[11] Patent Number: 6,062,493

[45] Date of Patent: May 16, 2000

[54] SPRAYER FOR LIQUIDS AND NOZZLE INSERT

[76] Inventor: Robert Henry Abplanalp, 10 Hewitt Ave., Bronxville, N.Y. 10708

[21] Appl. No.: 09/030,712

[22] Filed: Feb. 26, 1998

[51] Int. Cl.[7] ..... B05B 7/30

[52] U.S. Cl. ..... 239/318; 239/337; 239/434

[58] Field of Search ..... 239/310, 318, 239/337, 398, 418, 427, 433, 434; 222/136, 145.1, 145.5, 129, 135, 399

[56] References Cited

U.S. PATENT DOCUMENTS

| | | | |
|---|---|---|---|
| 912,106 | 2/1909 | Frazier | 222/145.1 |
| 1,989,912 | 2/1935 | Breuer | 239/398 |
| 2,954,678 | 10/1960 | Mahon et al. | 239/318 |
| 3,437,272 | 4/1969 | Abplanalp | 239/307 |
| 3,575,319 | 4/1971 | Safianoff | 222/135 |
| 4,382,552 | 5/1983 | Lubsen et al. | 239/317 |

*Primary Examiner*—Andres Kashnikow
*Assistant Examiner*—Lisa Ann Douglas
*Attorney, Agent, or Firm*—Kilgannon & Steidl

[57] ABSTRACT

A liquid sprayer with two side-by-side containers, an interconnecting bridge, and a nozzle insert positioned interiorly of the bridge. Alternatively, a two container piggyback liquid sprayer, a button actuator and a nozzle insert positioned interiorly of the button. One container is for product such as paint, etc., and the other container contains propellant. Very high product/propellant ratios are obtained. An intermediate portion of the nozzle insert has a venturi constriction with an internal propellant outlet orifice. Two product channels transverse to the nozzle insert longitudinal axis overlap the internal outlet orifice by approximately one-half. An outer frustoconical surface surrounds the internal venturi constriction outlet. An expansion chamber diameter is greater than the diameter of both the venturi constriction outlet orifice and the outer frustoconical surface adjacent this orifice. The venturi constriction outlet orifice is longitudinally spaced from the expansion chamber a distance to substantially prevent the propellant gas cone passing into the transverse product channels. The transverse product channels are quasi-rectanglar with areas greater than the venturi constriction outlet orifice. Internal bridge or button spaces extend about the intermediate portion of the nozzle insert. Other significant dimensional relationships are set forth.

8 Claims, 7 Drawing Sheets

10
11
12
13
14
15
17
17a
17b
18
30

SPRAYER FOR LIQUIDS AND NOZZLE INSERT

FIELD OF THE INVENTION

The present invention relates to sprayers for spraying paint and other liquids from a first container by use of pressurized propellant gas carried by and released from a second container.

BACKGROUND OF THE INVENTION

Paint sprayers, wherein the paint is contained in a first container and the propellant gas is contained in a second container, have advantages over single aerosol cans having both the propellant and paint contained therein. The latter form of packaging requires extensive inventories of aerosol cans with various colors, and the sales of a given color of paint may not be sufficient to warrant the production, marketing and stocking of aerosol cans with that given color of paint. The same may be said for other types of products marketed in aerosol cans, for example different types of insecticides, etc. However, in a two-container, hand-held spraying system of the aforementioned type, the product container may be used interchangeably with different colors or types of paints since the product container is detachable from the remainder of the spraying system. After spraying a particular color or type of paint placed in the product container, the product container is detached and cleaned so as to be ready to be refilled with a different (or the same) color or type of paint to be next sprayed. The propellant container is likewise detachable from the spraying system, so that when the propellant has been used up in the propellant container, a new container filled with propellant may be attached to the spraying system. As can be seen, such systems have considerable versatility and have become popular.

One type of two container system commercially available utilizes two side-by-side containers connected together by a bridge member. Propellant from the propellant can flows through the bridge and out the bridge through a nozzle that overlies a product tube extending down into the product container. The fast flow of the propellant over the end of the product tube creates a lowered pressure at that point such that the air pressure acting on the liquid in the product container forces product up the product tube and into the stream of propellant gas. In such systems a very low product to propellant ratio is obtained for reasons including that the pressure is only moderately lowered over the top of the product tube. Modifications of this type of side-by-side system have the bridge with its exit nozzle positioned forward of the top of the product tube, and with a form of nozzle insert positioned in the bridge near the exit nozzle. The propellant gas passes through the nozzle insert and likewise acts to lower the pressure over the end of the product tube to cause product flow into the stream of propellant gas. Such a latter system with a nozzle insert has a better product to propellant ratio, for example, of the approximate order of three to one, but there is still an excessive use of propellant. The nozzle inserts of such systems generally are poorly designed and do not create a sufficient vacuum over the top of the product tube.

A further type of two container system has the propellant container mounted piggyback on top of the product container. Product from a tube in the bottom container can flow up through a tube in the propellant container to an actuating button on the top of the propellant container. A nozzle insert in the button, generally operational as previously set forth, has resulted in the obtaining of enhanced product to propellant ratios of five or six to one for products of the viscosity of water. Such systems would benefit from a still further enhanced product to propellant ratio.

SUMMARY OF THE INVENTION

The present invention provides an embodiment of a liquid sprayer system having the above-described two side-by-side containers, an interconnecting bridge, a nozzle insert positioned interiorly of the bridge, and obtainable product to propellant ratios of approximately thirteen to one for products of the viscosity of water.

The nozzle insert has a rearward portion in fluid contact with a propellant channel in the interconnecting bridge; an intermediate portion containing a venturi constriction with an outlet orifice from which propellant may exit and at least two product channels adjacent the venturi constriction and extending substantially transverse to the longitudinal axis of the nozzle insert; and a forward portion containing an expansion chamber with an entrance diameter significantly larger than the diameter of the venturi constriction. The expansion chamber has a length sufficient to not substantially disrupt the vacuum established by the venturi constriction outlet at the transverse product channels.

An interior bridge space extends about the intermediate portion of the nozzle insert and also is in fluid communication with both an opening into the bridge from the product container and the transverse product channels. The transverse product channels extend longitudinally forward of the venturi constriction and also extend longitudinally rearwardly to longitudinally overlap the venturi constriction, the latter overlap being by approximately half the longitudinal dimension of the product channels in an embodiment of the present invention. A smoothly tapering, for example frustoconical, surface surrounds the venturi constriction outlet, the smaller forward outer diameter of the tapering surface being less than the entrance diameter of the expansion chamber. A smooth product flow extends from the product chamber into the gas stream exiting the venturi constriction orifice.

The venturi constriction outlet is longitudinally spaced from the entrance of the expansion chamber such that the circumference of the envelope of a cone of propellant gas exiting the constriction outlet remains substantially equal to or less than the circumference of the expansion chamber entrance until the cone enters the expansion chamber. If this cone becomes larger in circumference, the propellant gas exiting the constriction outlet will pass in part up into the transverse product channels to create eddy circuits and lower the vacuum created by the venturi constriction, thereby lowering product to propellant ratios.

In the present invention, the transverse product channels have areas substantially greater than the area of the venturi constriction outlet orifice, and for increased product flow, may have an outer opening of a shape having both curved and linear components forming a quasi-rectangular shape. The nozzle insert also is a unitary member in the embodiment described.

An alternative embodiment of the present invention utilizes a two container piggyback liquid sprayer system, wherein the same aforedescribed nozzle insert is correspondingly mounted within a space in the button actuator on top of the propellant container. Propellant to product ratios of water viscosity products are obtainable of the order of approximately nine to one.

Other features and advantages of the present invention will be apparent from the following description, drawings and claims.

DESCRIPTION OF EMBODIMENTS

Figure 1:
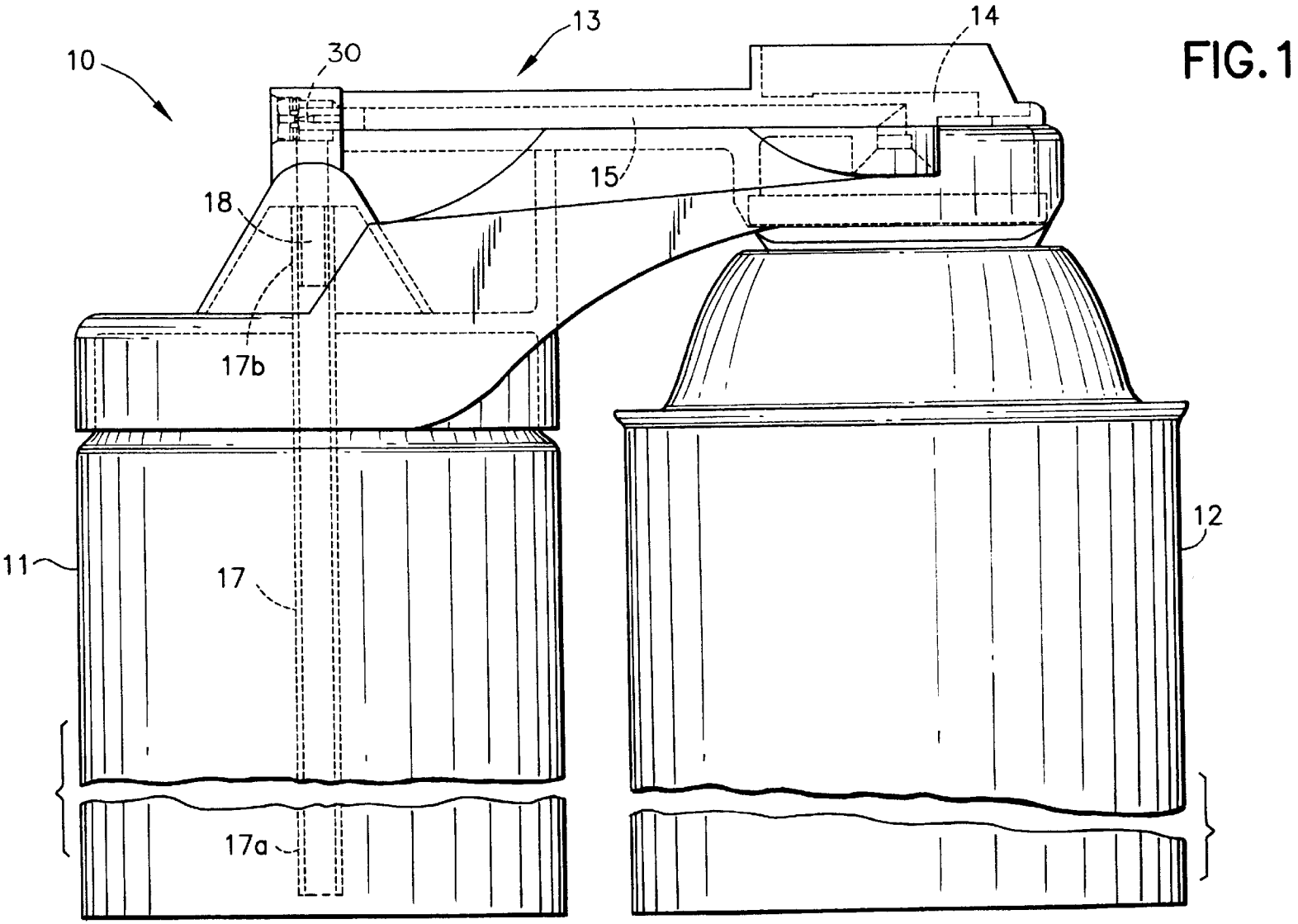
FIG. 1 is a side elevation view of a liquid sprayer having two side-by-side separate containers and an interconnecting bridge.
Figure 2:
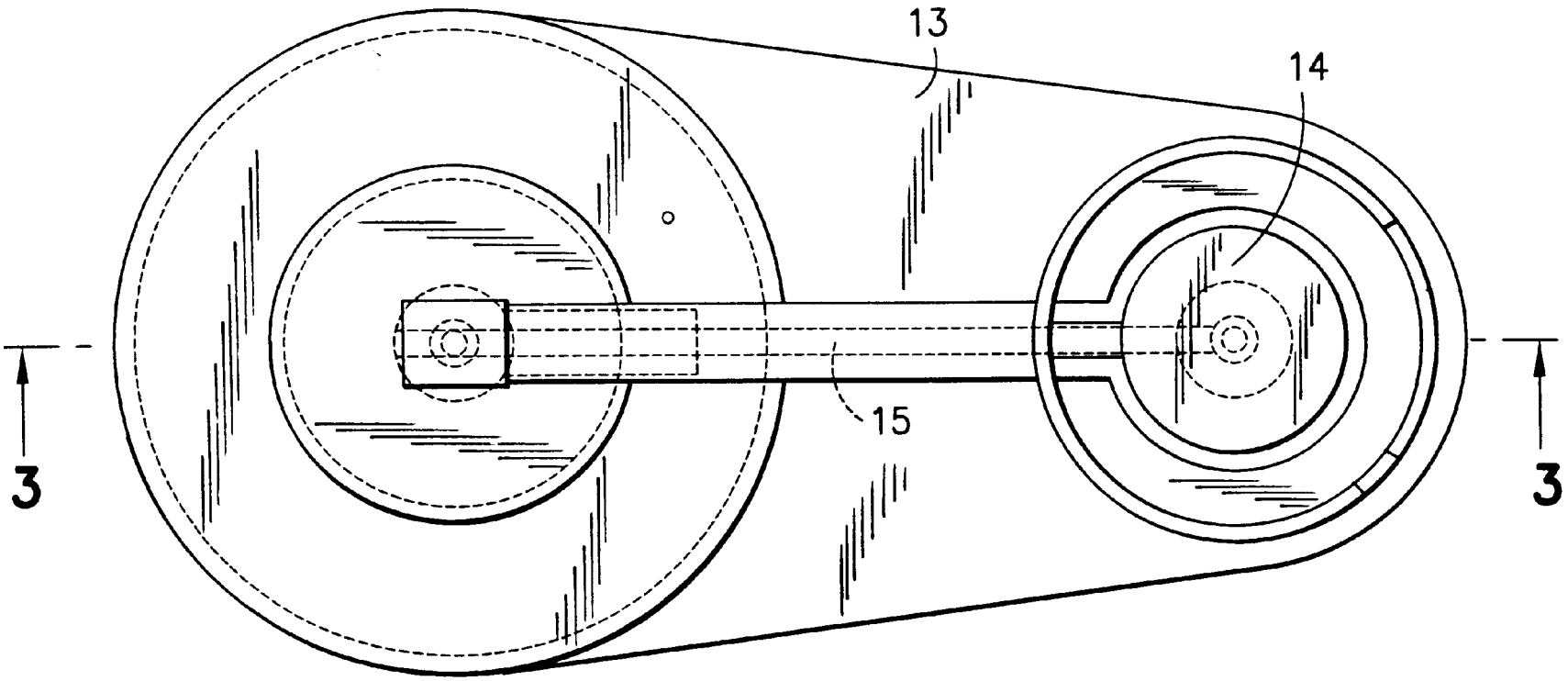
FIG. 2 is a top plan view of the interconnecting bridge of the sprayer of FIG. 1.
Figure 3:
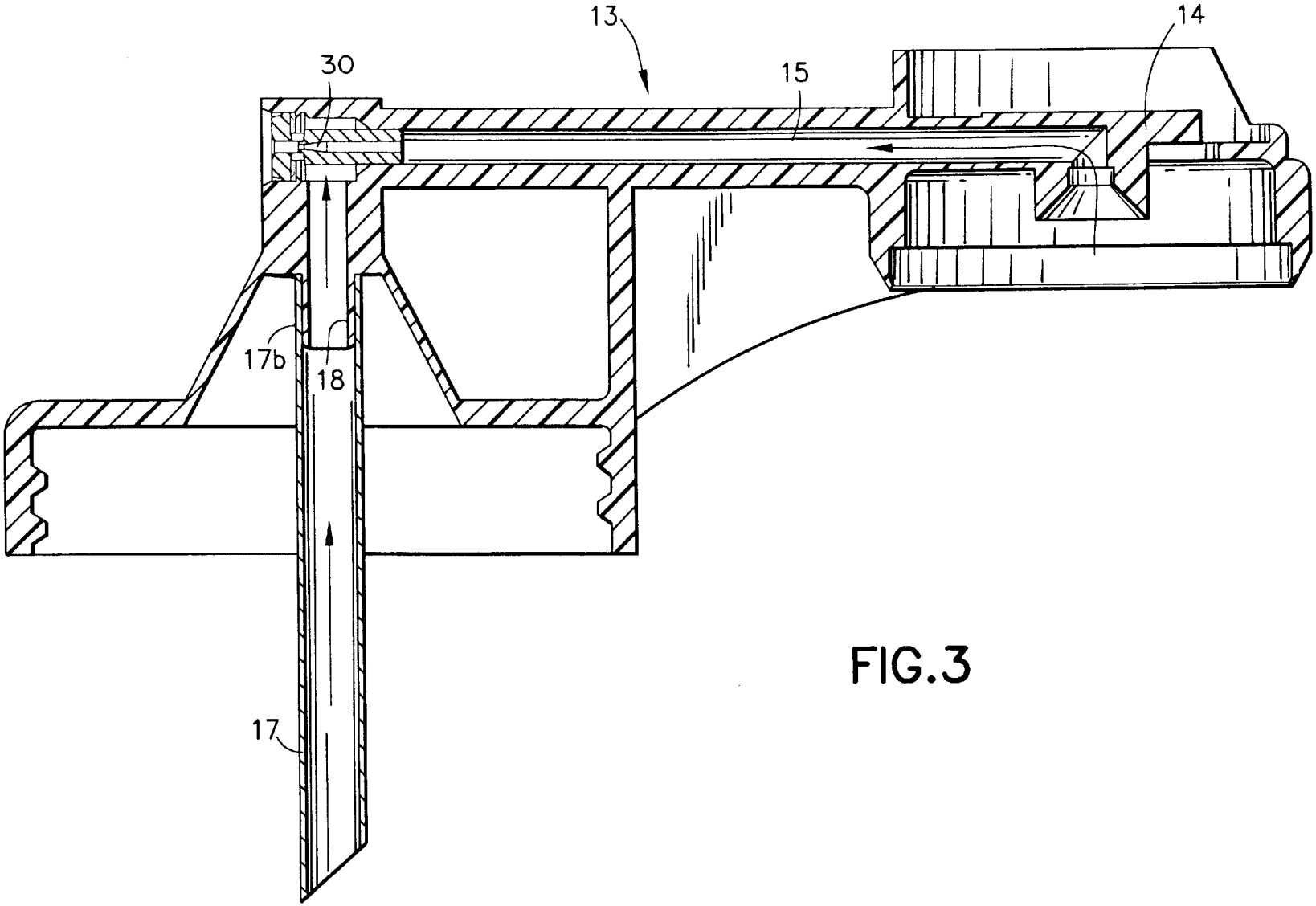
FIG. 3 is a longitudinal cross-sectional view of the interconnecting bridge of the sprayer of FIG. 1 taken along line 3—3 of FIG. 2.

FIGS. 1–3 illustrate generally a liquid sprayer 10 having a container 11 for material to be sprayed, such as paint, a container 12 containing an aerosol propellant, and an interconnecting bridge 13. The aerosol propellant may be in the form of a partially liquified propellant gas under substantial pressure. Interconnecting bridge 13 is molded of plastic and can be snapped onto container 12. Container 12 has a conventional aerosol valve mounted at its top into a conventional aerosol mounting cup. Bridge 13 in its position directly above container 12 may have flexible depending lugs that fit within the conventional aerosol mounting cup to retain the bridge 13 on container 12. Alternatively, a depending circular flange from the bridge may snap over the outside of the mounting cup. Bridge 13 also has a hinged depressible member 14, which when pressed by the finger of a user of the sprayer actuates the aerosol valve to release propellant gas from the aerosol container 12 up into an internal channel 15 in bridge 13. The valve stem of the aerosol valve fits into a central opening in the lower surface of depressible member 14, so that when member 14 is pressed downwardly, propellant gas flows up the aerosol valve stem into bridge channel 15 as shown by the arrow in FIG. 3.

When gas is released from aerosol container 12, it flows forwardly along the internal channel 15 to an inlet of a nozzle insert 30 contained within the bridge 13. The outlet of a venturi constriction within nozzle insert 30 draws product into the bridge 13 from product container 11, the bridge portion over the product container having screw threads to nest with screw threads on the top of container 11. One end 17*a* of a tube 17 extends nearly to the bottom of container 11, and the other end 17*b* of tube 17 surrounds a tubular part 18 of bridge 13 which part 18 has an internal channel providing a flow path for product into the bridge and ultimately to a position adjacent the venturi constriction outlet. The outlet of the venturi constriction with its reduced pressure creates a vacuum, and the air pressure over the liquid in container 11 forces product from container 11 up tube 17 into the bridge. The product and propellant gas are mixed and exit sprayer 10 as a spray.

Figure 4:
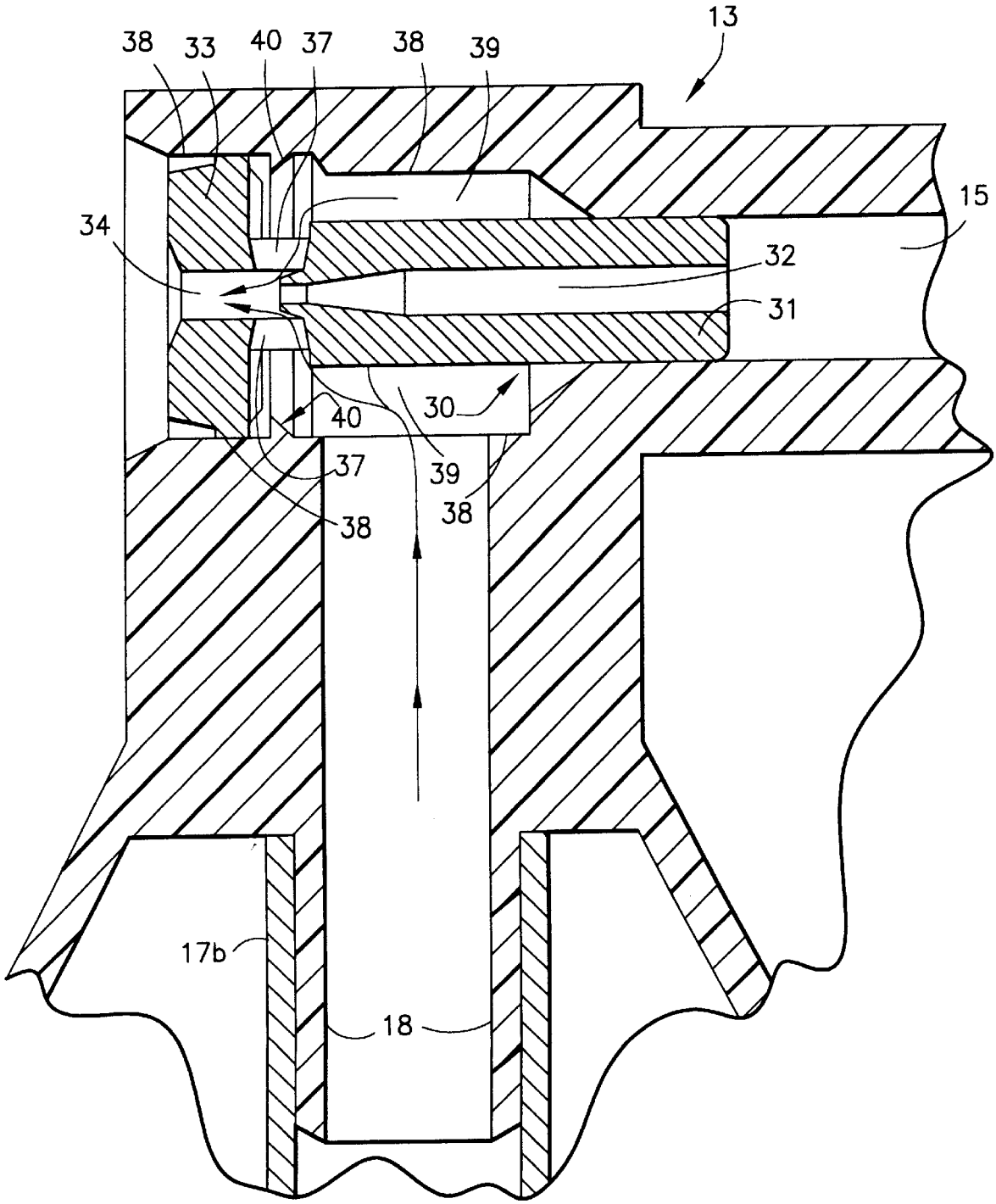
FIG. 4 is a fragmentary cross-sectional view of a portion of FIG. 3 but on an enlarged scale to illustrate the nozzle insert of the present invention mounted within the interconnecting bridge.

Referring now to FIGS. 4–8, the novel molded plastic nozzle insert 30 is illustrated, also including its particular interrelationship with bridge 13 as shown in FIG. 4. These structures will first be described, followed by a description of the more critical aspects thereof.

Nozzle insert 30 extending along its central longitudinal axis has a rearward portion 31 containing channel 32 leading forwardly toward the venturi constriction, and forward portion 33 containing an expansion chamber 34. Intermediate portion 35 of nozzle insert 30 contains the venturi constriction and two transverse product channels 37.

FIG. 4 illustrates the nozzle insert 30 contained within the interconnecting bridge 13 in a forward end opening 38 thereof. Both the outer surfaces of nozzle insert 30 and the inner surfaces of bridge end opening 38 are circular in cross-sectional planes perpendicular to the central longitudinal axis of nozzle insert 30, except as otherwise shown or described hereinafter in relation to the entrance to product channels 37. The nozzle insert 30 may be inserted from the forward end of sprayer 10 and captured by a circumferential bead on the side wall of the opening 38 in the bridge 13. Bridge 13 is shown in FIG. 4 having the depending tubular part 18 over which is fitted the end 17*b* of aforementioned product tube 17 extending into container 11. Product flows up tube 17 and into the cylindrical space 39 within the bridge surrounding the nozzle insert 30. From this cylindrical space 39, product flows into the two diametrically opposite product channels 37, further described below, extending to the interior of the nozzle insert 30. This flow of product is shown by the arrows in FIG. 4. Frustoconical surface 40 of bridge 13 serves to assist in directing the product flow inwardly toward product channels 37. Cylindrical channel 32 of nozzle insert 30 is of course in axial communication with internal gas channel 15 of bridge 13.

Referring now to FIGS. 5–8 illustrating the nozzle insert 30 per se, it will be observed that cylindrical channel 32 extends forwardly to converging channel 50 and narrowed terminal cylindrical channel 51 forming the venturi constriction and having a circular constriction outlet orifice 52. The diameter of the constriction outlet orifice 52 for the gas propellant from container 12 is significantly smaller than the diameter of cylindrical expansion chamber 34, as will be hereinafter discussed. Further, the forward end of channel 51 is spaced a particular distance in the longitudinal direction from the circular edge 53 of forward portion 33 surrounding expansion chamber 34, also as further discussed below.

Figure 5:
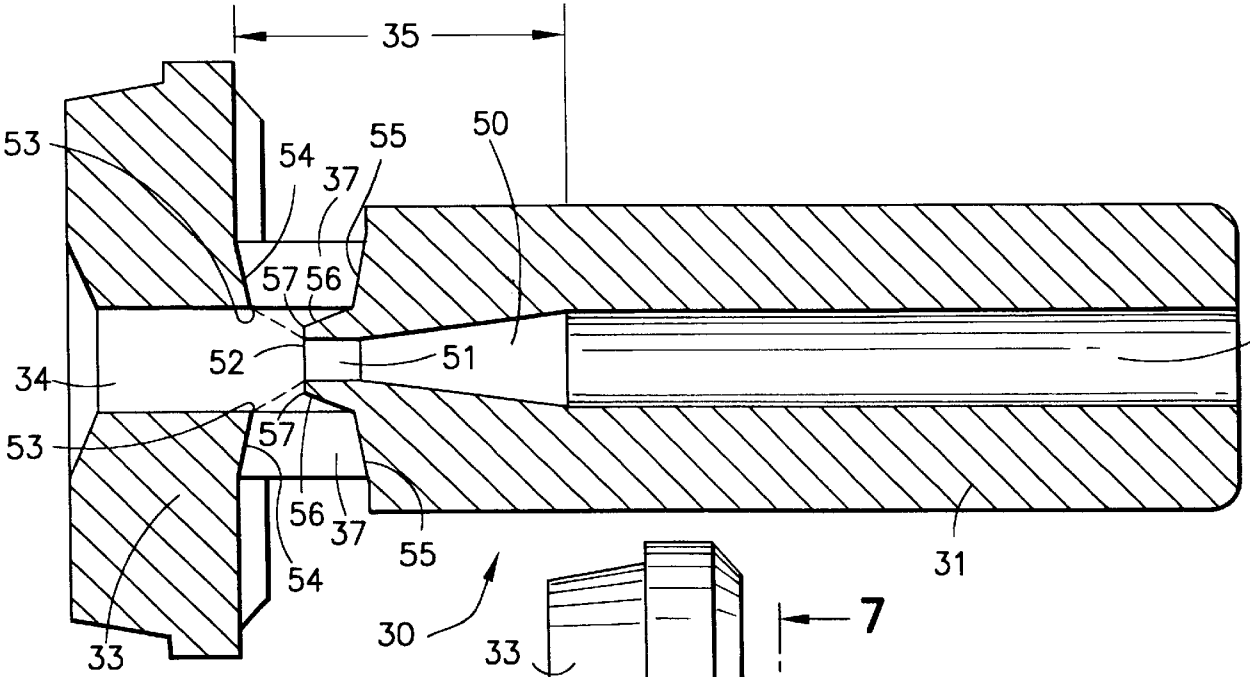
FIG. 5 is a cross-sectional view of solely the nozzle insert shown in FIG. 4.
Figure 6:
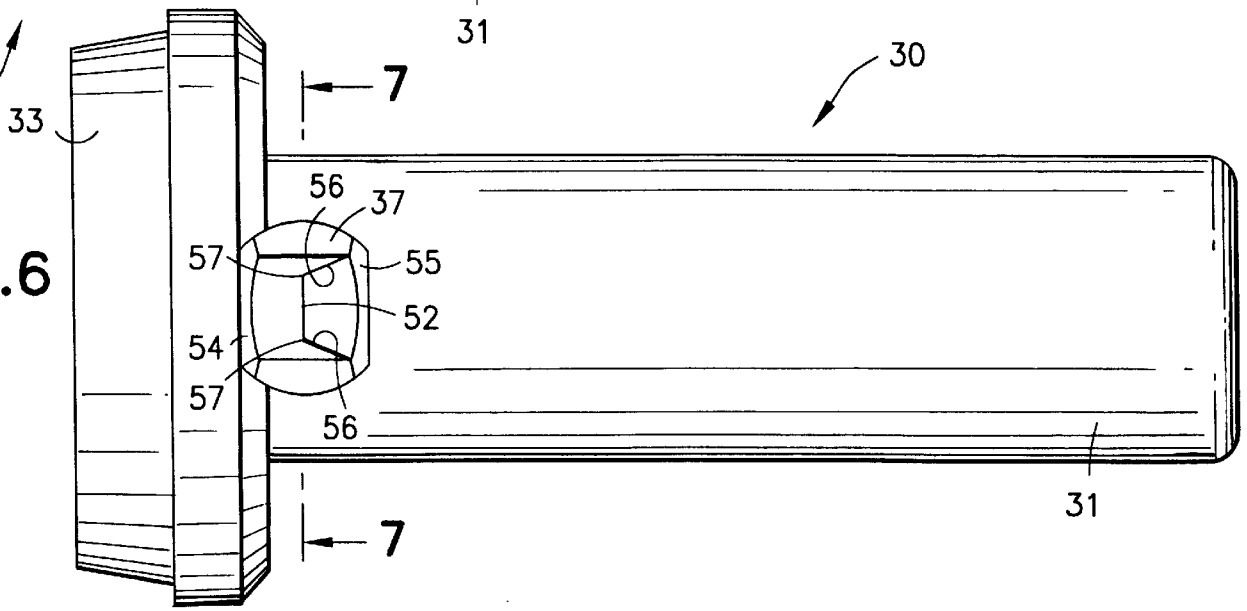
FIG. 6 is a top plan view of the nozzle insert shown in FIG. 5.

It will be noted that the two product channels 37 extend generally laterally inwardly toward the longitudinal axis of nozzle insert 30. Product channels 37 extend longitudinally in a forward direction from gas outlet 52 to forward portion 33 of nozzle insert 30, and extend longitudinally in a rearward direction from gas outlet 52 to significantly overlap the venturi constriction and its outlet. This amount of overlap is approximately half the longitudinal span of the product openings 37 in the embodiment shown. The forward surfaces 54 of the product openings 37 extend inwardly and rearwardly as shown in FIGS. 5 and 6. The rearward surfaces 55 of product openings 37 extend forwardly and inwardly as shown in FIGS. 5 and 6. Frustoconical or otherwise smoothly tapering surface 56 that surrounds channel 51 also serves as an inwardly and forwardly directed continuation surface of rearward surfaces 55 of the product openings 37, serving to smoothly direct the product flow inwardly and forwardly to mix with the propellant in expansion chamber 34.

Figure 8:
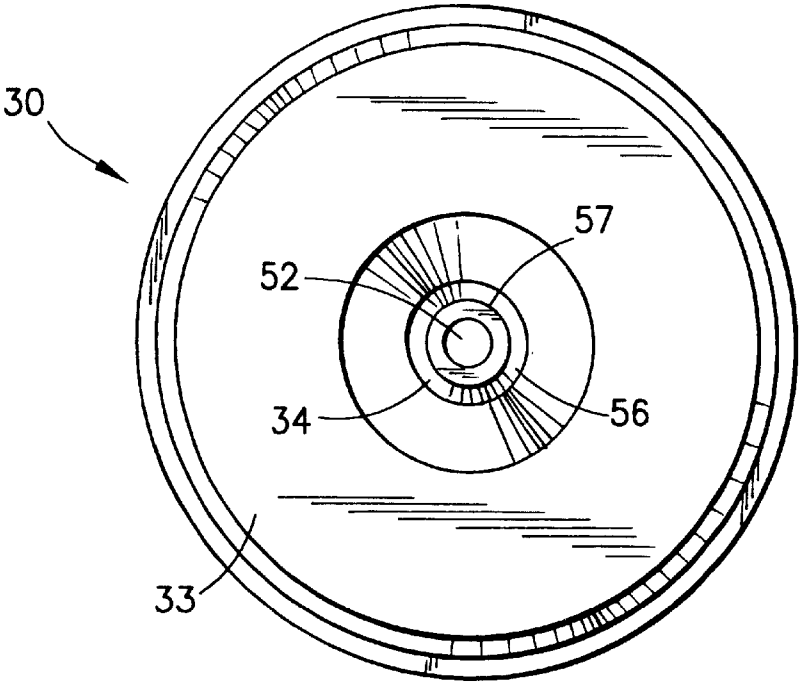
FIG. 8 is a front elevation view of the nozzle insert shown in FIG. 5.
Figure 7:
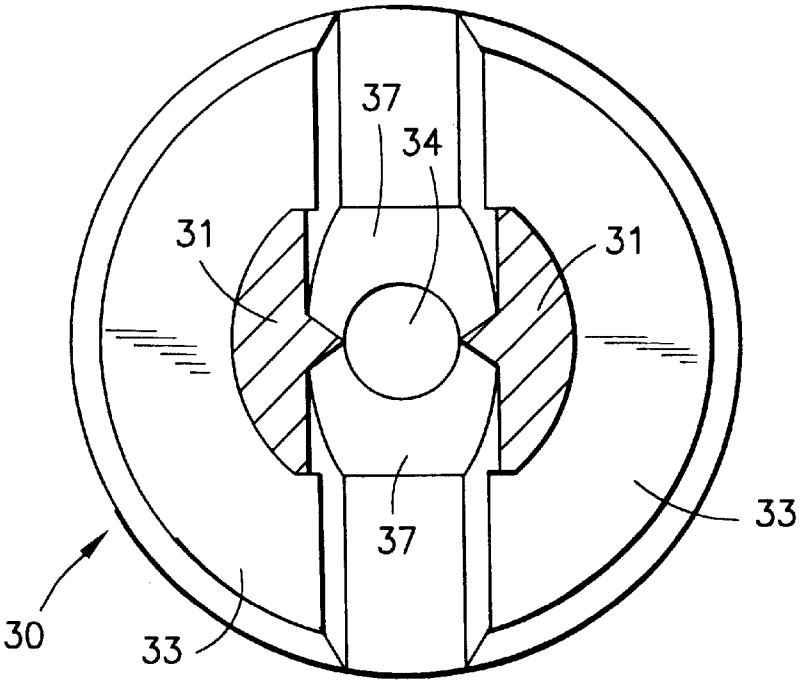
FIG. 7 is a transverse cross-sectional view of the nozzle insert taken along lines 7—7 of FIGS. 5 and 6.

Further referring to product openings 37, reference is made to FIG. 6. Each product opening 37 at its outer opening is in part circular (in the longitudinal direction) and in part rectangular (in the transverse direction), the latter aspect to provide for a larger product flow than would be available with a fully circular opening for the same given longitudinal direction. FIG. 7 provides a further view of product channels 37 extending into nozzle unit 30, and FIG. 8 illustrates the front end exit of nozzle insert 30.

Figure 10:
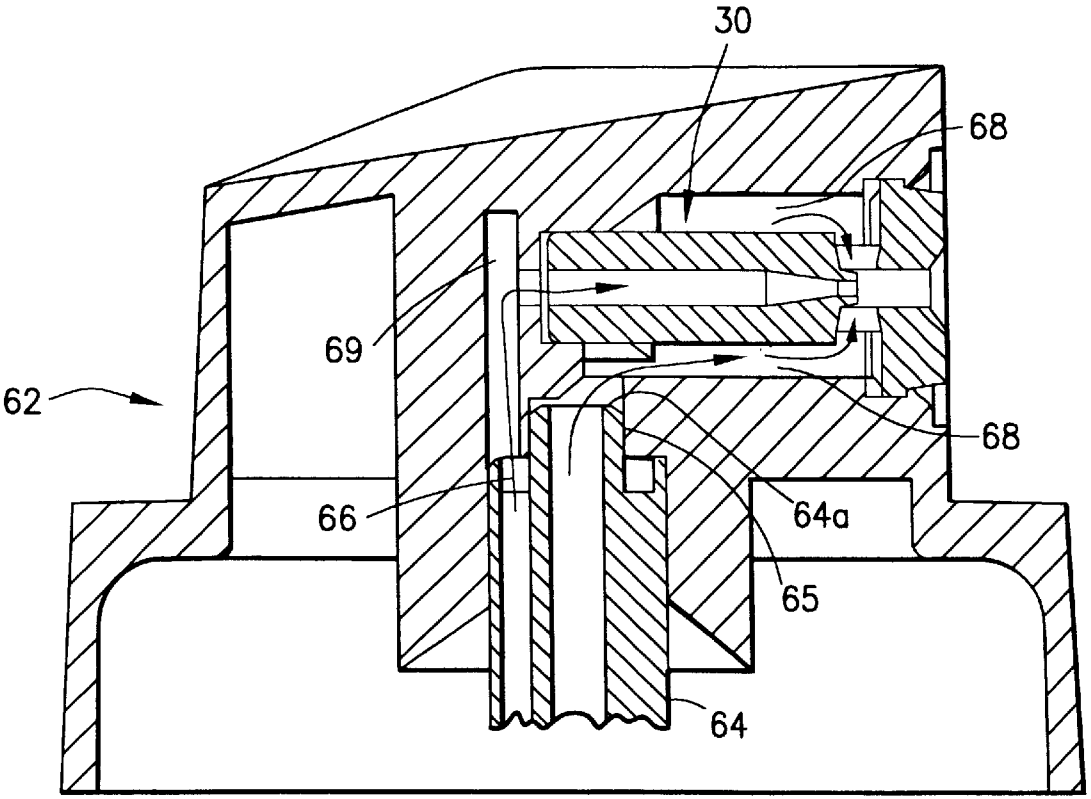
FIG. 10 is a fragmentary cross-sectional view on an enlarged scale of the top portion of FIG. 9, taken in a vertical diametrical plane and illustrating the nozzle insert of the present invention mounted in an actuating button.
Figure 9:
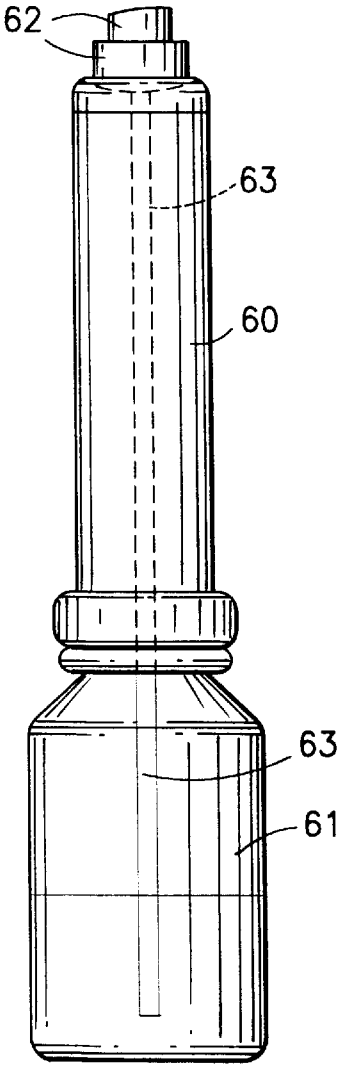
FIG. 9 is a side elevation view of an alternative form of liquid sprayer having two separate containers mounted one on top of the other, and in which the nozzle insert of the present invention may be used.

FIG. 9 illustrates an alternative form of liquid sprayer, having an aerosol propellant container 60 screwed onto liquid container 61 containing the product to be sprayed. Actuating button 62 when pressed downwardly serves to actuate the sprayer and is shown in enlarged detail in FIG. 10. Tube 63 carries liquid product up through the tube extending upwardly through container 60 to exit the upwardly extending central portion 64*a* of the aerosol valve stem 64 into the button 62, the button having a central opening 65 fitting over the upwardly extending central portion of 64*a*. The valve stem 64 also has three peripheral orifices 66 spaced one hundred and twenty degrees around the circumference of the valve stem 64 and exiting below portion 64*a*, one such orifice being shown in the cross-section of FIG. 10. Orifices 66 are valved by a conventional aerosol valve to the propellant in propellant container 60 when the valve stem is depressed by button 62.

Also contained within button 62 in its end opening 67 is the identical nozzle insert 30 of FIGS. 5–8 described above. When button 62 is depressed, the product flows into cylindrical space 68 surrounding the nozzle insert 30, and propellant flows up circumferentially extending channel 69 in button 62 overlapping orifices 66 and into the rearward end of nozzle insert 30. The nozzle insert functions exactly as described above in relation to FIGS. 4–8. Similar systems have been previously used as generally shown in FIG. 9, obtaining product to propellant ratios of the order of five or six to one for a product of water viscosity. However, the sprayer of FIGS. 9–10 having the nozzle insert 30 of FIGS. 4–8 and the button internal configuration of FIG. 10 has obtained product to propellant ratios of approximately nine to one for a product of water viscosity.

A number of elements of the above description and drawings are believed to be significant in obtaining the remarkable product to propellant ratios obtained in the present invention. Referring to FIGS. 4–8, it is presently believed to be important that:

(a) The longitudinal space from gas outlet orifice 52 extending forwardly to the entrance to expansion chamber 34, beginning at circular edge 53, needs to be dimensioned such that the outer circumference of the expansion cone of propellant gas exiting orifice 52 essentially remains less than or equal to the circumference of circular edge 53 until the gas has passed forwardly into the expansion chamber 34. This is shown diagrammatically in dotted line in FIG. 5. If this cone circumference becomes greater than this before its forward travel reaches circular edge 53, the high speed gas will pass in part back up into transverse product channels 37 to create eddy currents and lower the vacuum created by the venturi constriction. This of course will lower the product to propellant ratios desired.

(b) Gas outlet orifice 52 should have a significantly smaller diameter than the diameter of expansion chamber 34, both to allow for expansion and mixing and further to assure, in conjunction with the longitudinal space discussed in (a) above, that the circumference of the gas expansion cone does not significantly exceed the diameter of circular edge 53. Further, gas outlet orifice 52 should be sized in relation to the diameter of expansion chamber 34 and product channels 37 to obtain the desired product to propellant ratios.

(c) A significant amount of longitudinal overlap of transverse product channels 37, rearwardly from circular outlet orifice 52, is needed. As discussed above, this overlap is approximately half the longitudinal span of the product openings 37 in the embodiment described.

(d) The rearward surfaces 55 of the product openings 37, and the frustoconical surface 56 surrounding channel 51, should provide a smooth product flow through the product openings 37 and into the gas flow from gas outlet orifice 52. Sharp protruding edges along surfaces 55 and 56 may result in eddy currents in the product flow, resulting in a decrease in the desired product to propellant ratio. The frustoconical surface 56 should terminate in the forward direction at leading edge 57 having a diameter less than that of the diameter of circular edge 53 of expansion chamber 34, to flow the product from product channels 37 down into the gas stream exiting gas outlet orifice 52.

(e) The product channels 37 should be of a sufficient size to achieve the desired product to propellant ratios. The product openings can be enlarged as shown in FIG. 6 to have both circular and rectangular components as earlier described above. More product flow can then be obtained for a given longitudinal dimension of product channels 37, and a larger diameter product tube 17 can be used. Product tube 17 has an outer diameter of 0.158 inches in the embodiment here described.

(f) The longitudinal length of expansion chamber 34 needs to be sufficiently long so as to obtain proper expansion and mixing of the product and gas and also sufficiently long so as not to adversely affect the desired vacuum at product channels 37. However, the expansion chamber 34 should not be so long so as to create frictional back pressure resulting in less desirable spraying characteristics.

(g) The diameter of inlet 32 to the nozzle insert 30 needs to be sized in relation to the remaining diameters in the nozzle insert in order to obtain the desired product to propellant ratios.

The dimensions of a nozzle insert for a particular embodiment are set forth below. However, it should be understood that these dimensions may vary for embodiments constructed to spray products of varying viscosities and other characteristics. As can be seen, however, these dimensions are interrelated. It is presently believed that different dimensions for the orifices of the nozzle insert 30 described above will remain in substantially constant ratios with each other according to their respective areas. Likewise, the length of the expansion chamber 34 will probably vary in proportion to the orifice areas.

Dimensions of An Embodiment Of Nozzle Insert 30:

Diameter of Channel 32: 0.030 inches

Diameter of Orifice 52: 0.012 inches

Diameter of Expansion Chamber 34: 0.032 inches

Longitudinal Dimension of Each Channel 37: 0.040 inches

Transverse Dimension of Each Channel 37: 0.050 inches (at diameter)

Length of Nozzle Insert 30: 0.369 inches
Length of Channel 32: 0.212 inches
Length of Channel 50: 0.066 inches
Length of Channel 51: 0.018 inches
Length of Expansion Chamber 34: 0.049 inches
Maximum Outer Diameter Forward Portion 33: 0.185 inches
Outer Diameter Rearward Portion 31: 0.095 inches
Angle of Surface 56 to Longitudinal Axis: 17 degrees
Angle of Surfaces 55 to Transverse Axis: 11 degrees
Longitudinal Distance Edge 57 to Edge 53: 0.016 inches In the above embodiment of the present invention, as shown in the drawings and described, the design of the nozzle insert 30 combined with the tight fitting positioning thereof within bridge 13 or button 62, results in high vacuums being established at the transverse product channels 37 of the order of 40–50 centimeters of mercury, for example. The vacuum, combined with the other aforedescribed significant design features, results in remarkable product to propellant ratios of the order of approximately thirteen to one for products having the viscosity of water. This ratio is well in excess of that found in currently available paint sprayers and the like. Further, vinyl and enamel paints can be satisfactorily sprayed with sprayers of the present invention.

It will be appreciated by persons skilled in the art that variations and/or modifications may be made to the present invention without departing from the spirit and scope of the invention. The present embodiment is, therefore, to be considered as illustrative and not restrictive.

What is claimed is:

1. A liquid sprayer, comprising in combination a container for a liquid product to be sprayed, a valved container containing propellant, and an interconnecting bridge member for physically connecting the two containers in side by side relation; said bridge member having first means at a first end for attachment to the propellant container and second means at a second end for attachment to the product container; said bridge member having an enclosed channel to convey propellant from the first end to the second end of the bridge when the valved propellant container is actuated; a product opening extending into the bridge interior adjacent its second end for liquid product to flow into the bridge from the product container; a nozzle insert positioned interiorly of the bridge within a bridge opening at the second end of the bridge; said nozzle insert having a rearward portion, an intermediate portion and a forward portion; said nozzle insert rearward portion containing a channel in fluid communication with said bridge enclosed channel; said nozzle insert intermediate portion containing a venturi constriction with an outlet orifice from which propellant may exit and at least two product channels adjacent the venturi constriction and extending substantially transverse to the longitudinal axis of the nozzle insert; said nozzle insert forward portion containing an expansion chamber having an entrance diameter which is significantly larger than the diameter of the venturi constriction outlet orifice, and said expansion chamber having a length sufficient to not substantially disrupt the vacuum established by the venturi constriction outlet at the transverse product channels; an interior bridge space extending about the intermediate portion of the nozzle insert and in fluid communication with both the product opening extending into the bridge and the at least two transverse product channels; said nozzle insert transverse product channels extending longitudinally forward of said venturi constriction and extending longitudinally rearwardly to longitudinally overlap said venturi constriction; said venturi constriction outlet being surrounded by an outer smoothly tapering surface having its smaller diameter in the forward direction and its larger diameter in the rearward direction; the smaller forward outer diameter of the tapering surface being less than the entrance diameter of the expansion chamber; the transverse product channels having rearward surfaces that extend to the larger diameter of said tapering surface, said rearward surfaces and said tapering surface characterized by an absence of protruding surfaces so as to provide for smooth product flow therealong; said venturi constriction outlet being longitudinally spaced from the entrance to the expansion chamber such that the circumference of the envelope of a cone of propellant gas exiting the venturi constriction outlet remains substantially equal to or less than the circumference of the expansion chamber at its entrance until the cone enters the expansion chamber.

2. The invention of claim 1, wherein said nozzle insert transverse product channels longitudinally overlap said venturi constriction by approximately half the longitudinal dimension of the product channels.

3. The invention of claim 1, wherein the said outer tapering surface surrounding the venturi constriction outlet is a frustoconical surface.

4. The invention of claim 1, wherein said nozzle insert is a unitary member.

5. The invention of claim 1, wherein said transverse product channels each have an area substantially greater than the area of the venturi constriction outlet orifice.

6. The invention of claim 1, wherein sprayed product to propellant ratios of approximately thirteen to one are obtained for products of the viscosity of water.

7. The invention of claim 1, wherein each said transverse product channel has an outer opening of a shape having both curved and linear components.

8. The invention of claim 1, wherein the entrance diameter of the expansion chamber opening and the diameter of the venturi constriction outlet orifice are respectively approximately 0.032 inches and 0.012 inches or multiples thereof, the expansion chamber opening and the venturi constriction outlet orifice having areas in a ratio of approximately seven to one.

* * * * *